US005710958A

United States Patent [19]

Raj

[11] Patent Number: 5,710,958

[45] Date of Patent: Jan. 20, 1998

[54] METHOD FOR SETTING UP AN ELECTROPHOTOGRAPHIC PRINTING MACHINE USING A TONER AREA COVERAGE SENSOR

[75] Inventor: Guru B. Raj, Fairport, N.Y.

[73] Assignee: Xerox Corporation, Stamford, Conn.

[21] Appl. No.: 689,299

[22] Filed: Aug. 8, 1996

[51] Int. Cl.[6] ..... G03G 15/00

[52] U.S. Cl. ..... 399/49; 399/53

[58] Field of Search ..... 399/49, 53, 58, 399/60, 72, 55

[56] References Cited

U.S. PATENT DOCUMENTS

| | | | |
|---|---|---|---|
| 3,094,049 | 6/1963 | Snelling . | |
| 4,553,033 | 11/1985 | Hubble, III et al. | 250/353 |
| 4,647,184 | 3/1987 | Russell et al. | 399/48 |
| 4,853,738 | 8/1989 | Rushing | 399/39 |
| 5,016,050 | 5/1991 | Roehrs et al. | 399/50 |
| 5,075,725 | 12/1991 | Rushing et al. | 399/11 |
| 5,122,835 | 6/1992 | Rushing et al. | 399/49 |
| 5,150,155 | 9/1992 | Rushing | 399/39 |
| 5,175,585 | 12/1992 | Matsubayashi et al. | 399/49 |
| 5,436,705 | 7/1995 | Raj . | |

*Primary Examiner*—Robert Beatty

*Attorney, Agent, or Firm*—H. Fleischer; J. E. Beck; R. Zibelli

[57] ABSTRACT

A method for adjusting image quality in a printing machine having a variable density image developed on a photoconductive surface in accordance with an initial set of starting values. The method includes a first layer of detecting a plurality of densities of the variable density image and transmitting a plurality of signals with each signal being indicative of a density; generating new starting values, responsive to the plurality of signals, using a linearized perturbation model; calculating error values, responsive to the plurality of signals, minimizing the sum of the squares of the error values; testing the error values for convergence on a set of reference values with each reference value indicative of an acceptable density; repeating the detecting, transmitting, generating, calculating, and testing steps for a plurality of iterations. If the error values exceed the reference values and the plurality of iterations exceed a prescribed value (non-convergence), it will branch to a second and third layer of controlling the development bias voltage and adjusting the toner concentration. If convergence is not obtained in either the second or third layer, an image quality fault will be issued.

5 Claims, 9 Drawing Sheets

METHOD FOR SETTING UP AN ELECTROPHOTOGRAPHIC PRINTING MACHINE USING A TONER AREA COVERAGE SENSOR

The present invention relates generally to an electrophotographic printing machine, and more particularly concerns using a single sensor in a set up procedure that places the machine in readiness for proper operation.

An electrophotographic printing process has a photoconductive member which is electrostatically charged and then exposed to a light pattern of an original image to selectively discharge the surface in accordance therewith. The resulting pattern of charged and discharged areas on the photoconductive member form an electrostatic charge pattern known as a latent image. The latent image is developed by contacting it with a dry or liquid marking material having a carrier and toner. The toner is attracted to the image areas and held thereon by the electrostatic charge on the photoconductive member. Hence, a toner image is produced in conformity with a light image of the original being reproduced. The toner image is transferred to a copy substrate, and the image affixed thereto to form a permanent record of the image to be reproduced. Subsequent to development, excess toner left on the photoconductive member is cleaned from its surface. The process is useful for copying from an original document with a light lens system or for printing electronically generated or stored originals with a Raster Output Scanner (ROS) system.

In the commercial application of such products it is necessary to employ a set up procedure to adjust the machine states for optimal operation. Typically, the set up is accomplished by adjusting the development field, cleaning field, exposure intensity, and toner concentration. Several types of feedback sensors are used to measure these states. The states are then adjusted successively to establish a desired operating range that brings the density of the image within prescribed limits. When the characteristics of the photoreceptor and other materials are altered by aging and environmental changes, machine performance is degraded and must be restored via the set up procedure. Since the typical set up procedure is time consuming and costly, it would be highly desirable to provide an improved set up procedure.

The following disclosures may be relevant to various aspects of the present invention.

U.S. Pat. No. 3,094,049

Patentee: Snelling

Issued: Jun. 18, 1963

U.S. Pat. No. 4,553,033

Patentee: Hubble III et al.

Issued: Nov. 12, 1985

U.S. Pat. No. 5,436,705

Patentee: Raj

Issued: Jul. 25, 1995

These disclosures may be briefly summarized as follows:

U.S. Pat. No. 3,094,049 discloses an apparatus for determining the concentration of toner in a developer mixture of carrier and toner with a carrier medium. Wedge shaped toner deposition patterns are measured and compared to known concentrations having predetermined bias voltages applied thereto. Complete development occurs in the central portion of the wedge rearwardly from the tip and to a width where the field strength is sufficient to cause toner deposition. Beyond the maximum width, edge development occurs and it is regarded that development occurs at a threshold indicated by means of broad area coverage ability. The density of the toner development is measured by optical techniques to relate toner density to potential contrast as compared to standards achieved with known concentrations. The measuring apparatus is used in a development system of a printing machine to provide a feedback signal for controlling the toner dispensing rate.

U.S. Pat. No. 4,553,0033 discloses an infrared densitometer for measuring the density of toner particles on a photoconductive surface. A test patch is recorded on the photoconductive surface by a test patch generator. The patch is then developed with toner particles. Infrared light is emitted from the densitometer and reflected back from the developed test patch. Control circuitry, associated with the densitometer, generates electrical signals proportional to the developer toner mass of the test patch.

U.S. Pat. No. 5,436,705 discloses an adaptive process controller for controlling image parameters in an electrophotographic printing machine in a real-time mode. A Toner Area Coverage (TAC) sensor detects density values and generates corresponding signals indicative of a composite toner image representing the tonal reproduction curve. A toner concentration sensor detects and generates a corresponding signal for the level of toner concentration in the developer unit. The signals from both sensors are conveyed to a linear quadratic controller and compared to target image parameters stored therein. Control signals are generated by the linear quadratic controller. They are based on the difference between the two sets of inputs. An identifier receives both the sensor signals and the control signals. It then modifies the target images to compensate for changes in image quality due to material aging or environmental changes.

Pursuant to the features of the present invention, there is provided a method of adjusting image quality in a printing machine having a variable density image developed on a photoconductive surface in accordance with an initial set of starting values. The method includes detecting a plurality of densities of the variable density image and transmitting a plurality of signals with each signal being indicative of a density; generating new starting values, responsive to the plurality of signals, using a linearized perturbation model; calculating error values, responsive to the plurality of signals, minimizing the sum of the squares of the error values; testing the error values for convergence on a set of reference values with each reference value indicative of an acceptable density; repeating the detecting, transmitting, generating, calculating, and testing steps for a plurality iterations; branching to a component responsive to the error values exceeding the reference values and the plurality iterations exceeding a prescribed value, and adjusting the component.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
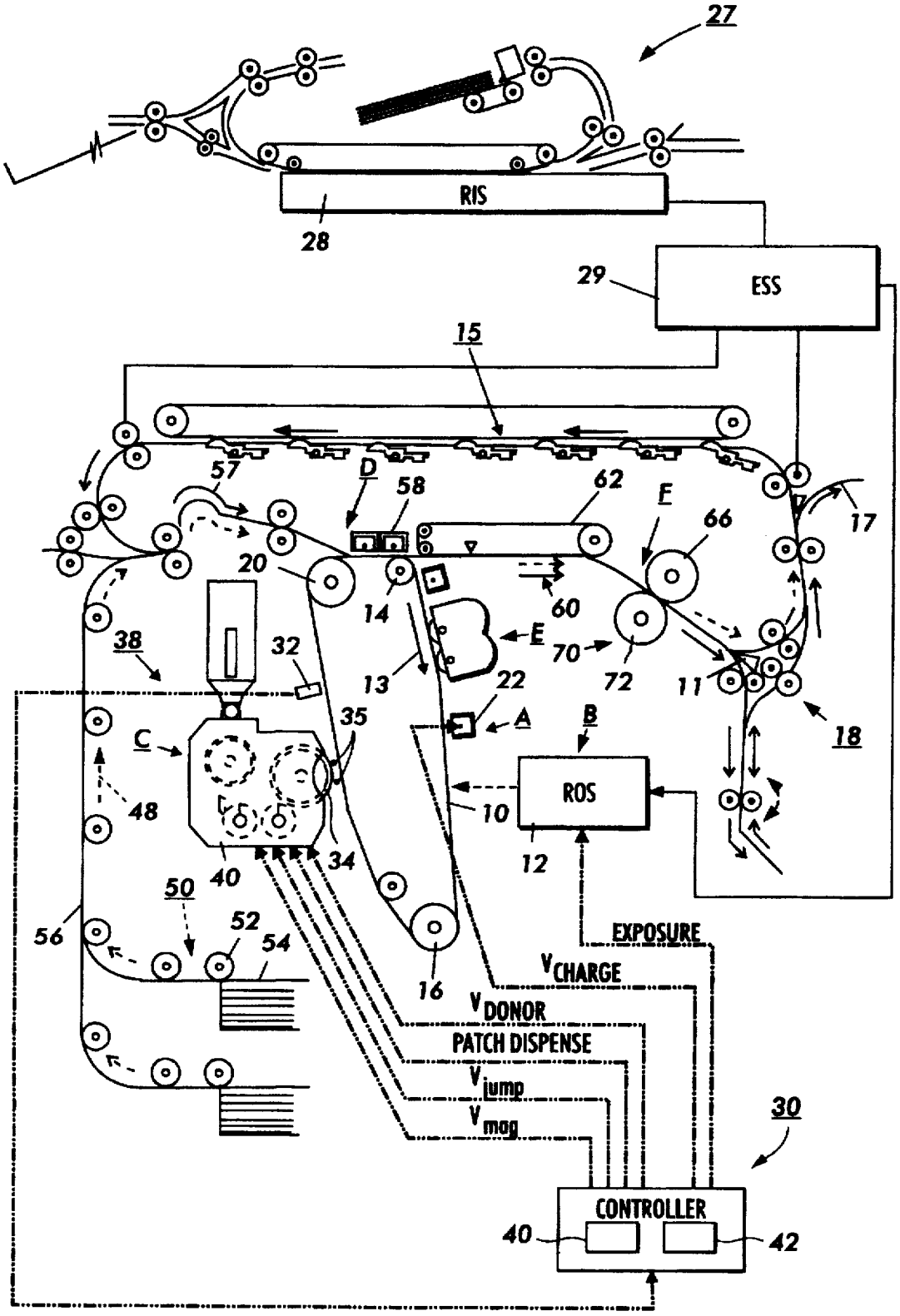
FIG. 1 is a schematic, elevational view showing an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the set up procedure of the present invention therein. It will become evident from the following discussion that this set up procedure is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter and their operation described briefly with reference thereto.

Referring to FIG. 1, an original document is positioned in a document handler 27 on a RIS indicated generally by reference numeral 28. The RIS contains document illumination lamps, optics, a mechanical scanning drive, and a charge-coupled device (CCD) array. The RIS captures the entire original document and converts it to a series of raster scan lines. This information is transmitted to an electronic subsystem (ESS) which controls a ROS described below.

Preferably, photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path movement thereof. Belt 10 is entrained about stripping roller 14, tensioning roller 16, and drive roller 20. As roller 20 rotates, it advances belt 10 in the direction of arrow 13.

Initially, a portion of the photoconductive surface passes through charging station A. At charging station A, a corona generating device, indicated generally by the reference numeral, 22 charges the photoconductive surface of belt 10 to a relatively high, substantially uniform potential.

At exposure station B, a controller or electronic subsystem (ESS), indicated generally by reference numeral 29, receives the image signals representing the desired output image and processes these signals to convert them to a continuous tone or gray-scale rendition of the image which is transmitted to a modulated output generator, for example the ROS, indicated generally by reference numeral 12. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 12. ROS 12 includes a laser with rotating polygon mirror blocks. The ROS will expose the photoconductive belt to record an electrostatic image thereon corresponding to the continuous tone image received from ESS 29. As an alternative, ROS 12 may employ a linear array of light emitting diodes (LEDs) arranged to illuminate the charged portion of photoconductive belt 10 on a raster-by-raster basis.

After the electrostatic latent image has been recorded on the photoconductive surface of belt 10, belt 10 advances the latent image to a development station C where, a development system 38 develops the latent image. Preferably, development system 38 includes a donor roll 34, a magnetic transfer roll, and electrode wires 35 positioned in a gap between the donor roll 34 and photoconductive belt 10. The magnetic transfer roll delivers toner to a loading zone (not shown) located between the transfer roll and the donor roll 34. The transfer roll is electrically biased relative to donor roll 34 to affect the mass per unit area deposition of toner particles from the transport roll to donor roll 34. One skilled in the art will realize that both the donor roll and magnetic transfer roll have A.C. and D.C. voltages superimposed thereon. The electrode wires 35 are electrically biased relative to donor roll 34 to detach toner therefrom and form a toner powder cloud in the gap between the donor roll 34 and photoconductive belt 10. The latent image attracts toner particles from the toner powder cloud forming a toner powder image thereon.

With continued reference to FIG. 1, after the electrostatic latent image is developed, the toner image present on belt 10 advances to transfer station D. A print sheet 48 is advanced to the transfer station D by a sheet feeding apparatus 50. Preferably, sheet feeding apparatus 50 includes a feed roll 52 contacting the upper most sheet from stack 54. Feed roll 52 rotates to advance the uppermost sheet from stack 54 into vertical transport 56. Vertical transport 56 directs the advancing sheet 48 of support material into registration transport 57 past image transfer station D to receive an image from belt 10 in a timed sequence so that the toner powder image formed thereon contacts the advancing sheet at transfer station D. Transfer station D includes a corona generating device 58 which sprays ions onto the back side of sheet 48. This attracts the toner powder image from the photoconductive surface of belt 10 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 66, with the powder image, on the copy sheet, contacting fuser roller 72.

The sheet then passes through fuser 70 where the image is permanently fixed or fused to the sheet. After the sheet passes through fuser 70, a gate 11 either allows the sheet to move directly via output 17 to a finisher or stacker, or deflects the sheet into the duplex path 15, specifically, into single sheet inverter 18. That is, if the sheet is either a simplex sheet, or a completed duplex sheet having both side one and side two images formed thereon, the sheet will be conveyed via gate 11 directly to output 17. However, if the sheet is being duplexed and is then only printed with a side one image, the gate 11 will be positioned to deflect that sheet into the inverter 18 and into the duplex loop path 15, where that sheet will be inverted and then fed for recirculation back through transfer station D and fuser 70 for receiving and permanently fixing the side two image to the backside of that duplex sheet, before it exits via path 17.

After the copy sheet is separated from the photoconductive surface of belt 10, the residual toner/developer and paper fiber particles adhering to the photoconductive surface are removed therefrom at cleaning station E. Cleaning station E includes a rotatably mounted fibrous brush in contact with the photoconductive surface of belt 10 to disturb and remove paper fibers and a cleaning blade to remove the non-transferred toner particles. The blade may be configured in either a wiper or doctor position depending on the application. Subsequent to cleaning, a discharge lamp (not shown) floods the photoconductive surface of belt 10 to dissipate any residual electrostatic charge remaining thereon prior to the charging thereof for the next successive imaging cycle.

The various machine functions are regulated by ESS 29. The ESS is preferably a programmable microprocessor which controls all of the machine functions described hereinbefore. The ESS provides a comparison count of the copy sheets, the number of documents being recirculated, the number of copy sheets selected by an operator, time delays, jam corrections, and etc.. The control of all the exemplary systems heretofore described may be accomplished by conventional control switch inputs from the printing machine console, as selected by the operator. Conventional sheet path sensors or switches may be utilized to keep track of the position of the original documents and the copy sheets.

In electrophotographic printing, toner material changes in development system 38 and PIDC (Photo Induced Discharge Characteristics) changes in photoconductive belt 10 influence the process. Aging and environmental conditions (that is, temperature and humidity) cause these changes. After 200,000 copies, the PIDC of photoconductive belt 10 is substantially different then when it was new. The tribo-electric charge on the toner material decays when the machine remains in non-print making condition. An idle period of 2–4 days reduces the charge by 8–10 tribo units. Thus, the machine has a set-up mode to adjust image quality output under different environmental conditions and age before real-time printing begins. The set-up mode does not pass paper through the machine. Instead it sets a plurality of nominal actuator values and sequentially performs one or more adjustment loops to obtain convergence on acceptable image quality parameters.

In FIG. 1, there is provided an adaptive controller 30 that adjusts image quality during the set-up mode. Adaptive controller 30 has a plurality of outputs comprising state variables used as actuators to control a Tonal Reproduction Curve. The Tonal Reproduction Curve is discussed hereinafter with reference to FIG. 2. The real-time operation of controller 30 is described in U.S. Pat. No. 5,436,705, which is hereby incorporated, in its entirety, into the instant disclosure. Adaptive controller 30 includes a Linear Quadratic Controller 40 and a Parameter Identifier 42 that divides the controller into the tasks of parameter identification and control modification. The state variable outputs of controller 30 are $V_{CHARGE}$, EXPOSURE, PATCH DISPENSE $V_{DONOR}$, $V_{mag}$ and $V_{jump}$-$V_{CHARGE}$ controls a power supply output (not shown) for the corona generating device 22. EXPOSURE controls the exposure intensity delivered by the ROS 12. PATCH DISPENSE controls the amount of dispensed toner required to compensate for toner test patch variations. $V_{DONOR}$ and $V_{jump}$ control DC and AC power supply voltages (not shown) applied to the donor roll 34 respectively. $V_{mag}$ controls a DC power supply voltage (not shown) applied to the magnetic transfer roll in developer system 38. Control algorithms for the Linear Quadratic 40 Controller and the Parameter Identifier 42 process information and adjust the state variables to achieve acceptable image quality during the set-up mode of machine operation.

During the set-up mode, image quality is measured by TAC (Toner Area Coverage) sensor 32. TAC sensor 32 is located after development station C. It is an infrared reflectance type densitometer that measures the density of toner particles developed on the photoconductive the surface of belt 10. The manner of operation of TAC sensor 32 is described in U.S. Pat. No. 4,553,033, which is hereby incorporated in its entirety into the instant disclosure.

The set-up mode is accomplished by using feedback from TAC sensor 32, the real-time adaptation techniques of controller 30, and indirect data of machine states to achieve the nominal Tonal Reproduction Curve targets. The set-up mode has three layers. The first layer consists of utilizing the real-time estimation routines to estimate the sensitivity coefficients based on the least square estimation principle described in U.S. Pat. No. 5,436,705. Changes to the controller design coefficients are further based on partial derivatives of the measured RR (Relative Reflectance) similar to charge voltage ($\delta V_{CHARGE}$), development potential ($\delta V_{BIAS}$), and exposure intensity (δExposure) described in U.S. Pat. No. 5,436,705 at column 8, lines 21–68 and column 9, lines 1–23. These estimates compensate for PIDC alterations to the photoreceptor caused by temperature, humidity, aging, and degradation of the ROS exposure levels. When the first layer does not bring the Tonal Reproduction Curve within specified limits, the set up advances to a second layer. The second layer adjusts the developer bias voltages based upon the donor roll actuator movements. Since the developer bias adjustment alone may not be adequate, in conditions of extreme tribo-electric variations, the set up mode advances to a third layer of toning up or toning down toner concentration based on actual relative reflectance levels and actuator levels. A detailed description of the three layer set up procedure will be discussed hereinafter with reference to FIGS. 4 through 10.

Figure 2:
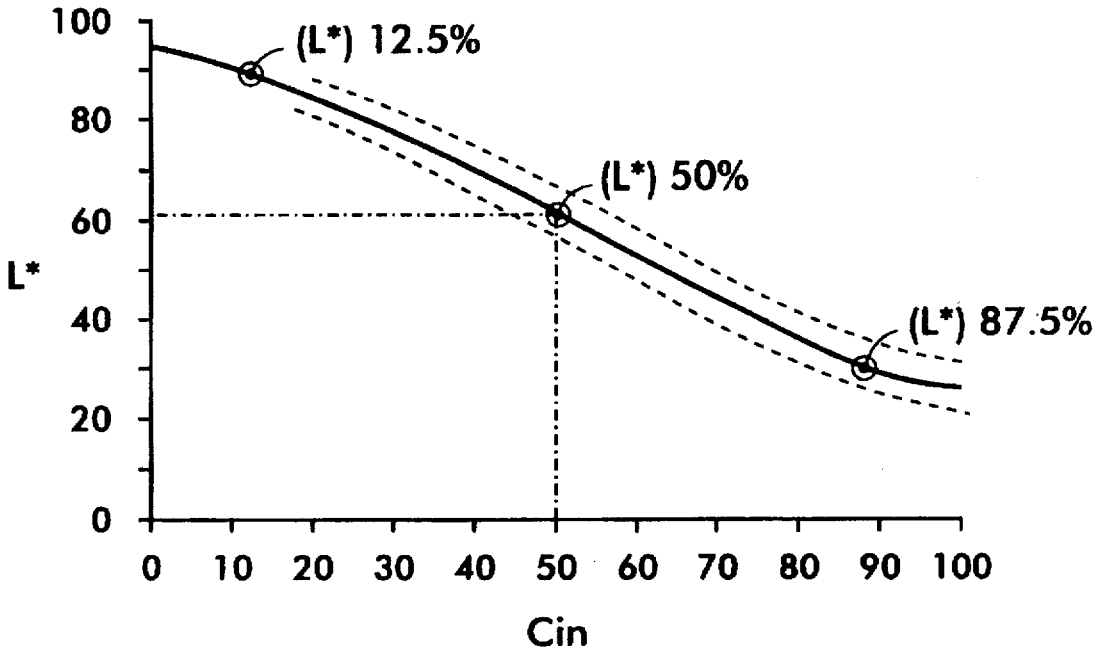
FIG. 2 is a graph showing a tonal reproduction curve.

A nominal Tonal Reproduction Curve is illustrated in FIG. 2. Tonal Reproduction Curve control provides uniform gray scale development and effective translation of halftones, highlights, and shadow details, as well as mid-tone densities. The control stability of all the density levels on the Tonal Reproduction Curve make photographic reproductions and other halftone documents invariant from machine-to-machine and copy-to-copy. Referring to FIG. 2, the Tonal Reproduction Curve is shown in terms of a measure of whiteness (L*) versus the toner area coverage ($C_{in}$) of developed image fill patterns. L* represents the differential response of the human eye to a developed image and is used as a metric for density variation. Since L* is non-linear in terms of density, density information for values of $C_{in}$ are converted to L* as explained in U.S. Pat. No. 5,436,705 at column 5, lines 56–68, and column 6, lines 1–11. The variations in the L* values shown in FIG. 2 are controlled to a standard deviation of plus or minus 2 units or 2 sigma-limits. The standard deviation is indicated graphically by a space defined between two opposing dotted lines adjacent to the Tonal Reproduction Curve. For example, the standard deviation for the majority of L* corresponding to a $C_{in}$ density of 50% should He in a range of 60±4, or 56 to 64. In this example, 56 and 64 are lower and upper threshold boundaries respectively. They are used to decide if image quality is satisfactory. If the image quality is above the upper boundary or below the lower boundary, it will not pass the set up mode.

Figure 3:
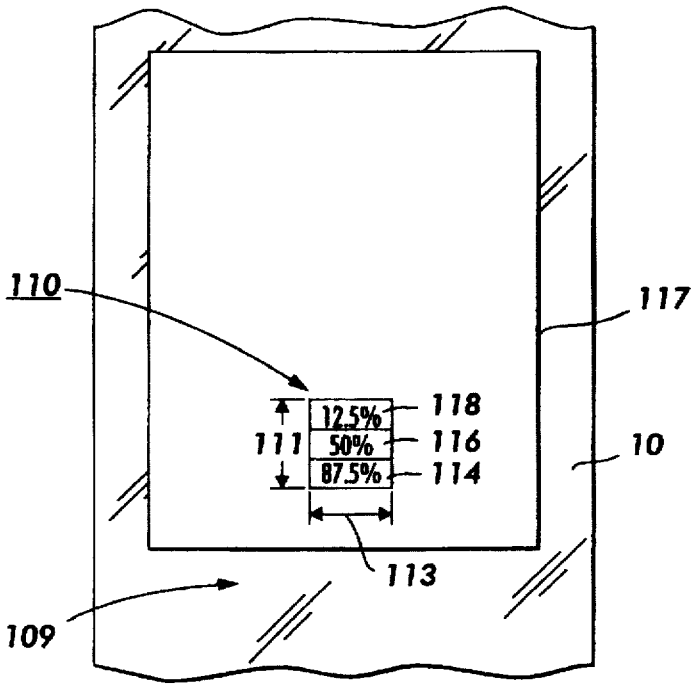
FIG. 3 shows a composite toner test patch recorded in the image zone of the photoconductive member during the set up mode of the present invention.

Referring to FIG. 3, a composite toner test patch 110 is shown in an image area 117 of photoconductive surface 10. The test patch 110 is that portion of the photoconductive surface 12 sensed by the TAC sensor to provide the necessary feedback signals for the set up mode. The composite patch 110 measures 15 millimeters, in the process direction (indicated by arrow 111), and 45 millimeters, in the cross process direction (indicated by arrow 113). Patch 110 consists of a segment 114 for solid area density (87.5%), a segment 116 for halftone density (50%), and a segment 118 for highlight density (12.5%). Before the TAC sensor can provide a meaningful response to the relative reflectance of the patch segments it must be calibrated by measuring the light reflected from a bare or clean area portion 109 of photoconductive surface 10. For sensor calibration purposes, current flow (in the light emitting diode internal to the TAG sensor) is increased until the voltage generated by the TAC sensor (in response to light reflected from area 109) is between 3 and 5 volts.

Figure 4:
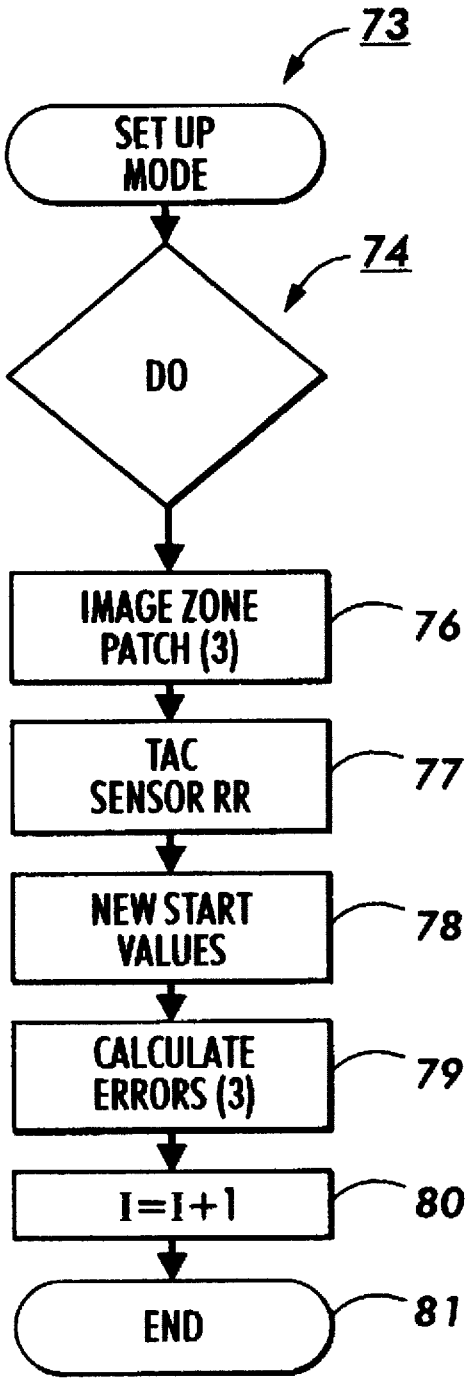
FIG. 4 is a diagrammatic representation of the operations in a set up mode procedure.

Turning now to FIG. 4, there is shown a diagrammatic representation of the operations involved in performing a set-up task. Set Up Mode 73 is a set of steps enclosed between a DO block 74 and an END 81. The enclosed steps are performed when Set UP Mode 73 is called by each layer of the present invention. Starting at step 76, bit patterns for the composite toner test patch are applied to an image area on the photoconductive surface, by a video module in the ROS. The ROS varies exposure intensity, pixel-by-pixel to correspondingly change the discharge potential that forms a latent test image on the photoconductive surface. As the photoconductive surface passes the development station, the test image is developed with toner material. At step 77, the TAC sensor detects light intensity reflected from the photoreceptor. Both the clean area and toned segments are measured. The reflectance change between the clean area and a lo measured patch segment forms a relative reflectance reading indicative of the developed toner mass for that segment. At step 78, readings generated by the TAC sensor are transmitted to the adaptive controller. The adaptive controller uses the real-time process control algorithms to generate new starting values responsive to the three test patch segments. The new starting values are calculated by using a linearized perturbation mode At step 79, the linear quadratic controller (internal to the adaptive controller) calculates the error terms detected by the TAC sensor with reference to the Relative Reflectance targets shown in FIG. 2. The linear quadratic controller calculates the error terms by minimizing the sum of the squares of the detected error terms. At step 80, counter I is incremented each time the operations in steps 76 through 79 are performed.

Figure 5:
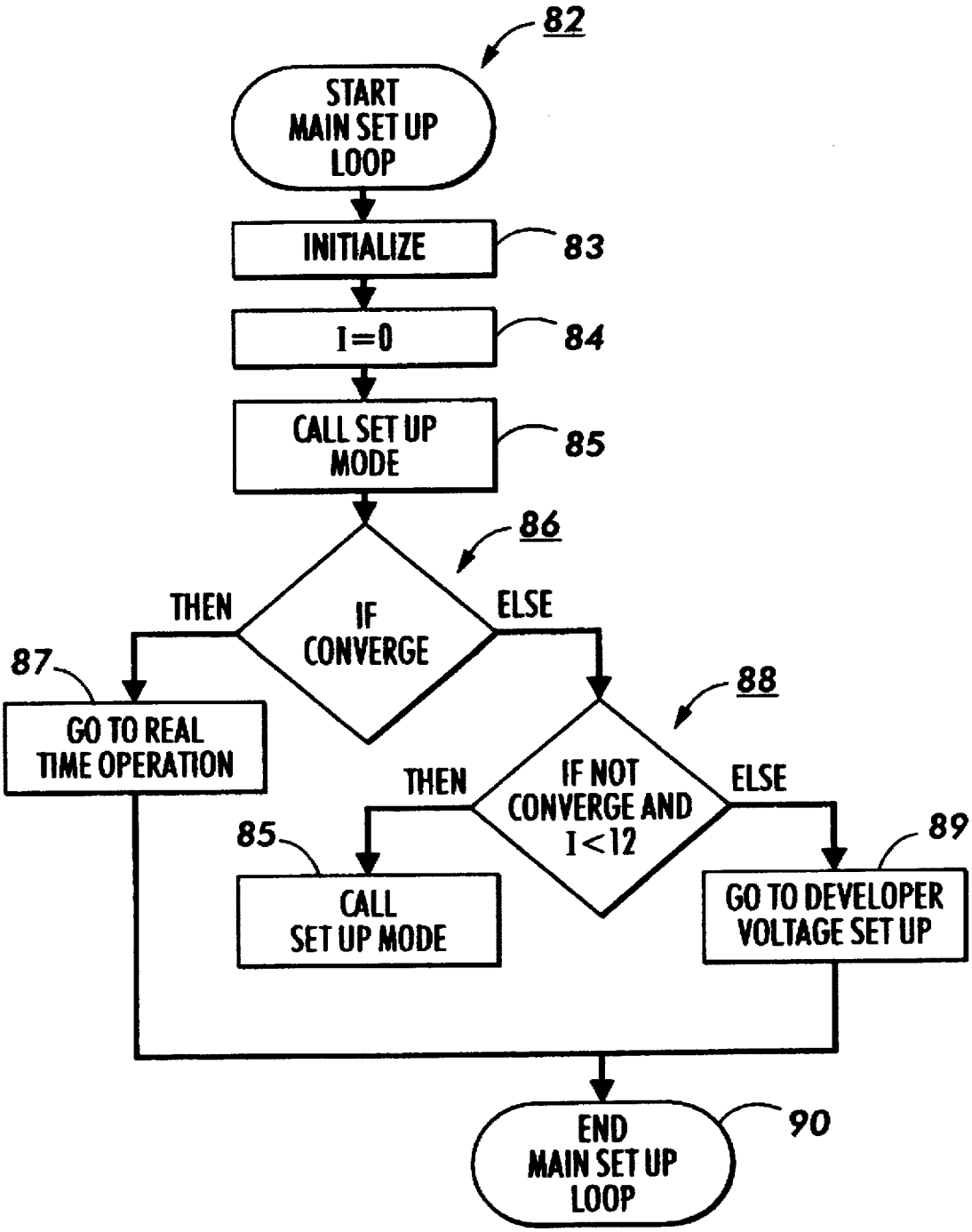
FIG. 5 is a flow diagram of a main set up loop for testing image quality.

FIG. 5 illustrates a flow chart for a first layer of the set up process. It is a Main Set Up Loop for testing image quality to the nominal Tonal Reproduction Curve and is contained between a Start 82 and an End 90. Step 83 initializes all control signals stored in non-volatile memory to their default or nominal values. These control signals include the state variables and unknown parameters θ. The θ parameters represent the sensitivity of L* with reference to the actuators as described in U.S. Pat. No. 5,436,705 at column 8, lines 35–39. The state variables are initialized to:

$V_{CHARGE}=V_{CHARGEnom}$;

$V_{DONOR}=V_{DONOR\ nom}$;

EXPOSURE=EXPOSURE$_{nom}$;

PATCH DISPENSE=PATCH DISPENSE$_{nom}$;

$V_{jump}=V_{jump\ nom}$; and $V_{mag}=V_{DONOR\ nom}+V_{dm\ nom}$ where $V_{dm\ nom}$ is the nominal potential difference between the magnetic transfer roll and donor roll.

Additionally, the non-volatile memory contains two constants $K_{dm}$ and $K_{JUMP}$. $K_{dm}$ is a gain term used to adjust the potential difference ($V_{dm}$) between the magnetic transfer roll and donor roll $K_{JUMP}$ is a gain term used to adjust the AC voltage ($V_{jump}$) applied to the donor roll. Calculations using the gain terms of $K_{dm}$ and $K_{JUMP}$ are given hereinafter with reference to FIG. 6.

With continued reference to FIG. 5, Counter I is set to zero at step 84 and the Set Up Mode (FIG. 4) is performed at step 85. At step 86, the three error terms calculated for a first iteration of the Set Up Mode, are tested for convergence towards the nominal Tonal Reproduction Curve. If convergence for each error term is found to be within a variation of ±4, step 86 branches to real-time machine operation at step 87 and the Main Set Up Loop ends at step 90. Alternatively, if there is non-convergence, step 86 branches to step 88. If at step 88, the value of I is less than 12, step 88 branches back to step 85 (call Set Up Mode) and repeats steps 86 through 88 until I equals 12. When convergence is not attained within 12 iterations, step 88 proceeds to the Developer Voltage Set Up Loop at step 89. The Main Set Up Loop ends at step 90.

In the Developer Voltage Set Up Loop, development parameters $V_{bplus}$ and $V_{bminus}$ are windows on both sides of the nominal $V_{DONOR}$ bias voltage. A high tribo-electric condition is indicated when Set Up Mode excursions lead to $V_{DONOR}$ bias voltage values above $V_{bplus}$. Likewise, values below $V_{bminus}$ indicate a low tribo-electric condition To neutralize these conditions, adjustments are made on $V_{dm}$ and $V_{jump}$.

Figure 6:
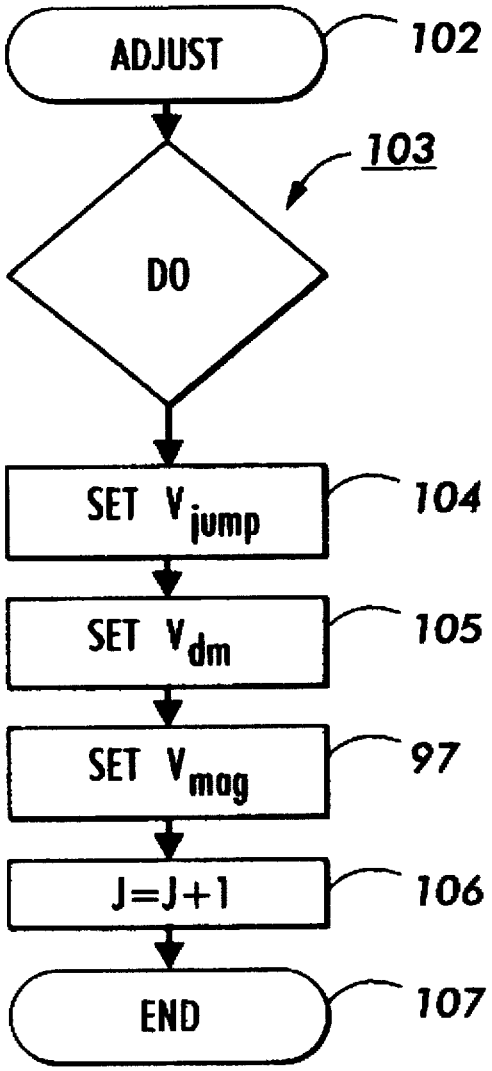
FIG. 6 is a diagrammatic representation of the operations for adjusting developer voltages.

FIG. 6 shows a diagrammatic representation of the steps for adjusting $V_{dm}$, $V_{jump}$, and Vmag. ADJUST is a sub routine procedure at step 102 having a set of steps that are enclosed between a DO block 103 and an END at step 107. ADJUST 102 is called by the Developer Voltage Set Up Loop which will be discussed hereinafter with reference to FIG. 7. At step 104, $V_{jump}$ is adjusted to a value of:

$$V_{jump}=V_{jumpnom}+K_{JUMP}*(V_{DONOR}-V_{DONOR\ nom}).$$

At step 105, $V_{dm}$ is adjusted to a value of:

$$V_{dm}=V_{dm\ nom}+K_{dm}*(V_{DONOR}-V_{DONOR\ nom}).$$

At step 97, $V_{mag}$ is adjusted to a value of:

$$V_{mag}=V_{DONOR}+V_{dm}.$$

At step 106, a counter J is incremented each time steps 103 through 107 are performed.

Figure 7:
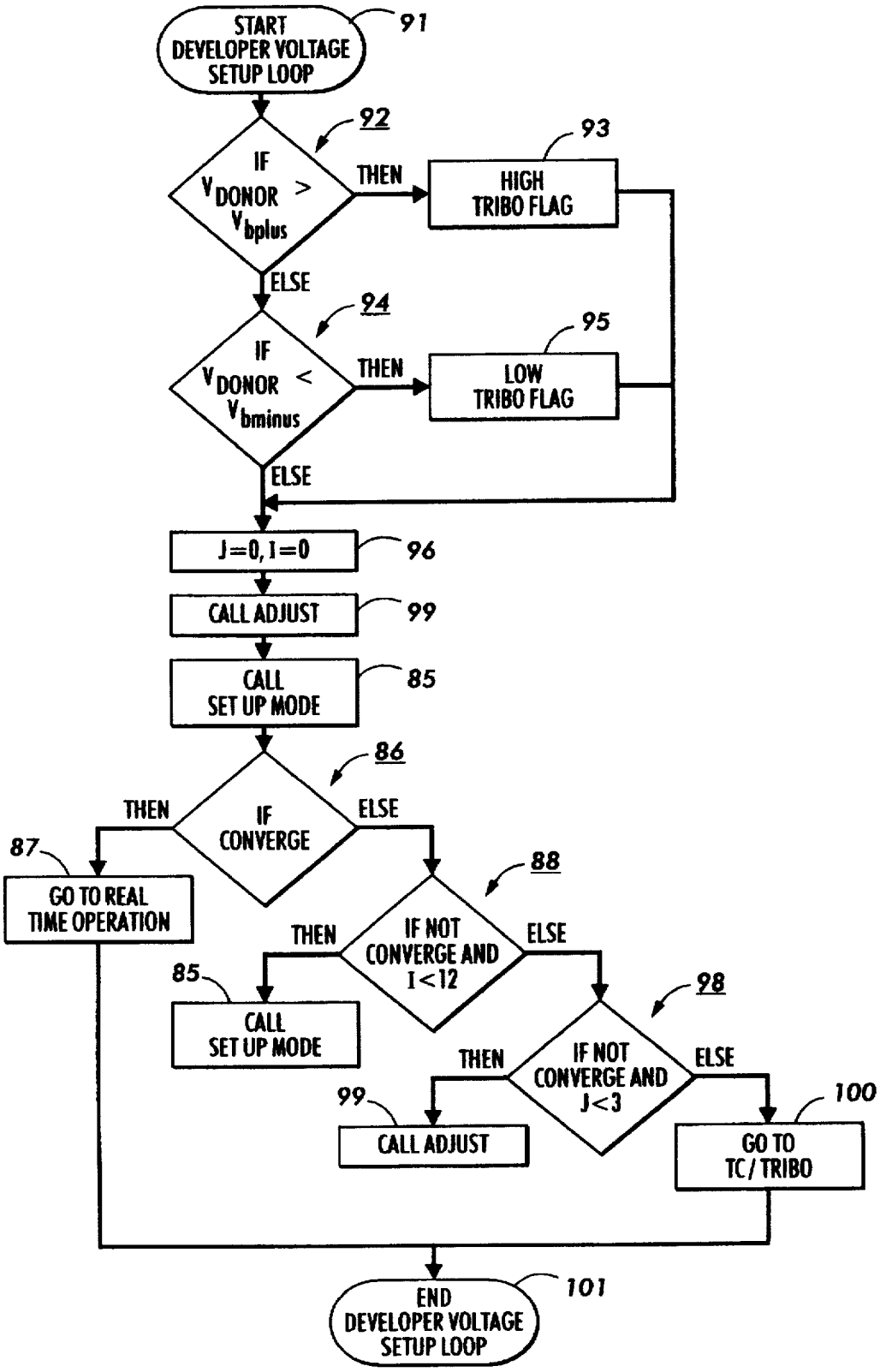
FIG. 7 is a flow diagram of a developer voltage set up loop; lo

FIG. 7 illustrates a flowchart for a second layer of the set up process. It is the Developer Voltage Set Up Loop and is contained between a START 91 and an END 101. At step 92, the value of the $V_{DONOR}$ bias voltage is compared to parameter $V_{bplus}$. If the $V_{DONOR}$ bias voltage is greater than $V_{bplus}$, a Tribo Flag indicative of a high tribo-electric condition is set at step 93. At step 94, the value of the $V_{DONOR}$ bias voltage is compared to parameter $V_{bminus}$. If the $V_{DONOR}$ bias voltage is less than $V_{bminus}$, then the Tribo Flag is set to indicate a low tribo-electric condition at step 95. Counters I and I are set to zero at step 96. ADJUST (FIG. 6) is performed at step 99 and the Set Up Mode (FIG. 4) is performed at step 85. At step 86, the three error terms calculated from the previous iteration of the Set Up Mode (FIG. 4) are tested for convergence towards the nominal Tonal Reproduction Curve. If convergence is established, step 86 branches to real-time machine operation at step 87 and the Developer Voltage Set Up Loop ends at step 101. Alternatively, if there is non-convergence, step 86 branches to step 88. If at step 88, the value of I is less than 12 iterations, then step 88 branches back to the Set Up Mode (FIG. 4) at step 85 and repeats steps 85, 86, and 88 while I is less than 12. When convergence is not attained within 12 iterations, step 88 branches to step 98. If at step 98, the value of J is less than 3 iterations, step 98 performs ADJUST (FIG. 6) at step 99, and repeats steps 85, 86, and 88 until I equals 3. If convergence is not reached within 3 iterations of J, the set up process enters a TC/Tribo Set Up Loop at step 100 and ends the Developer Voltage Set Up Loop ends at step 101.

Figure 8:
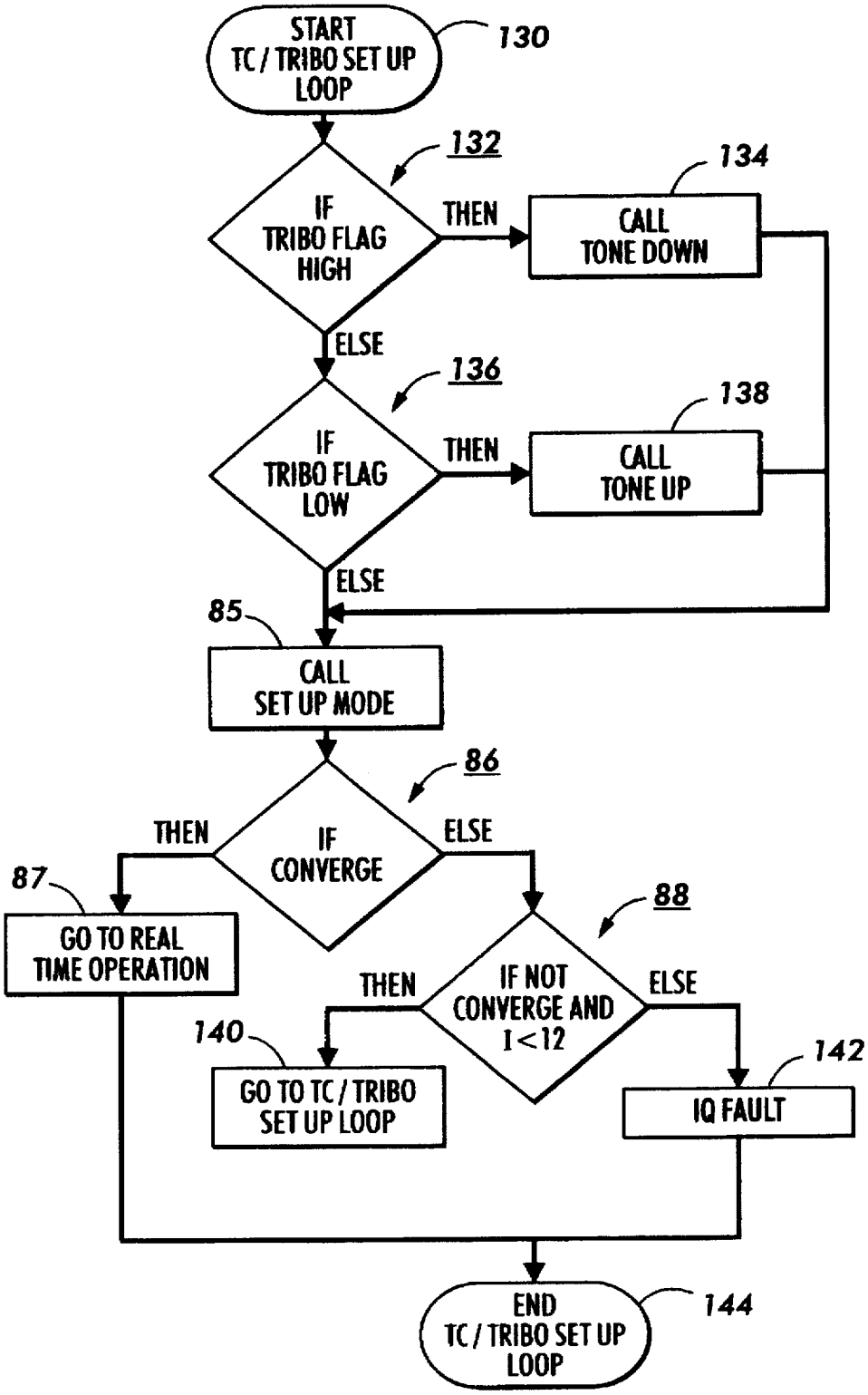
FIG. 8 is a flow diagram of a toner concentration/tribo set up loop.

FIG. 8 illustrates a flow chart for a third layer of the set up process. It is the third layer in the set-up process and is entered when developer bias voltages alone are not able to compensate for significant shifts in toner material property. The third layer is a TC/Tribo Set Up Loop and is contained between a Start 130 and an End 144. At step 132, the condition of the Tribo Flag is tested for a high state. If the flag is high, then a Tone Down routine is called, at step 134. At step 136, the Tribo Flag is tested again for a low state. If the flag is low, a Tone Up routine is called at step 138. Both the Tone Down and Tone Up routines will be discussed hereinafter with reference to FIGS. 9 and 10, respectively. The Set Up Mode (FIG. 4) is performed at step 85. At step 86, the three error terms calculated during the last Set Up Mode (FIG. 4), are tested for convergence on the nominal Tonal Reproduction Curve. If convergence is established, step 86 branches to real-time machine operation at step 87 and the TC/Tribo Set Up Loop ends at set 144. Alternatively, if there is non-convergence, step 86 branches to step 88. If at step 88, the value of I is less than 12, step 88 returns the beginning of the TC/Tribo Set Up Loop, at step 140 and repeats the loop heretofore described. If convergence is not attained within 12 iterations, the set-up process declares an IQ (Image Fault) convergence fault at step 142 and ends the TC/Tribo Set Up Loop at step 144.

Figure 9:
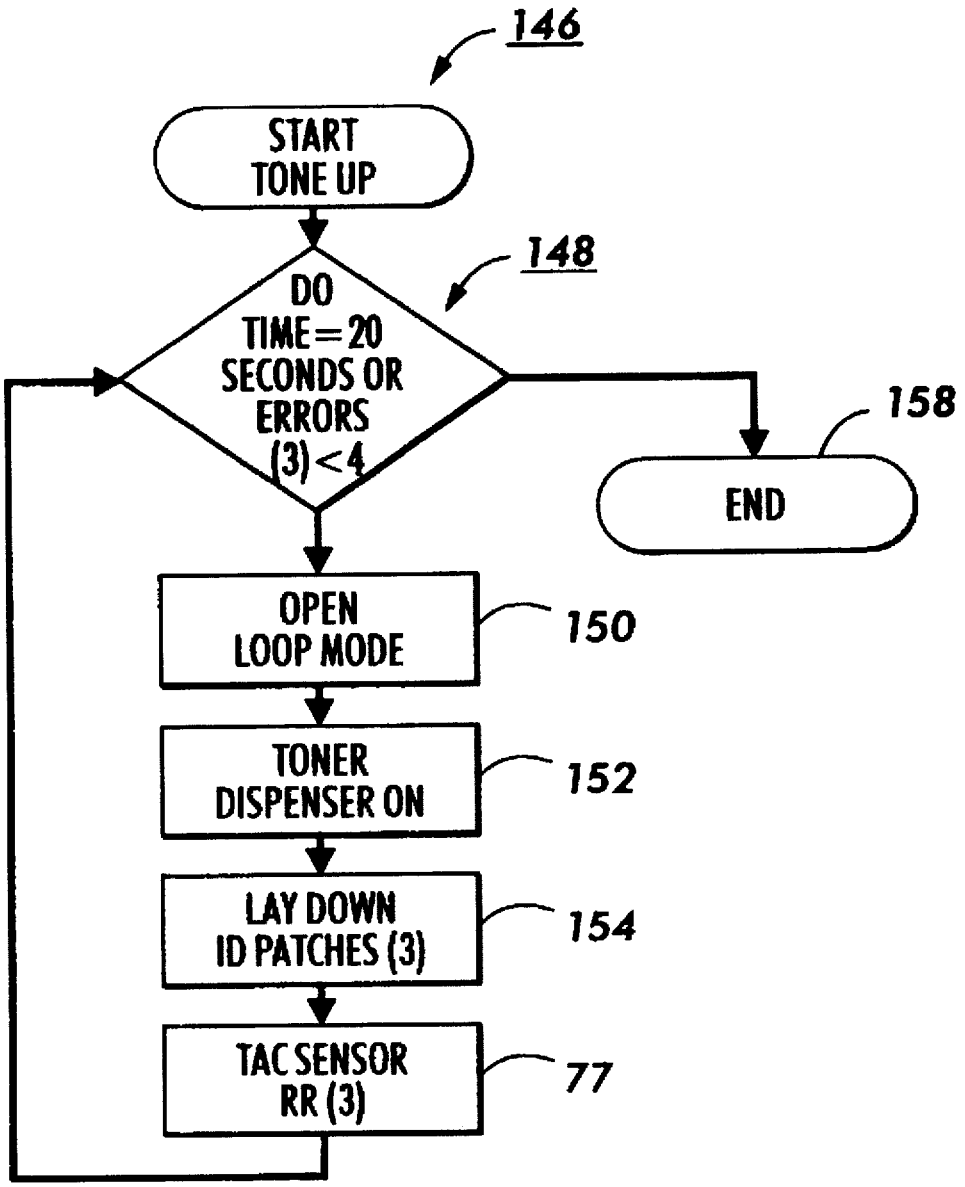
FIG. 9 is a diagrammatic representation of the operations involved in increasing toner concentration with a tone up routine in the TC/Tribo Set Up loop.

Referring to FIG. 9, there is shown a diagrammatic representation of the Tone Up routine which starts at step 146. The Tone Up routine is a set of steps enclosed between a DO block 148 and an END 158 to increase toner concentration. At step 150, the printing machine is placed in an open loop mode so that paper does not pass through the machine. All voltages remain at their current settings. The toner dispenser is turned on, at step 152, to add toner particles to the developer unit. At step 154, the composite toner test patch (described in U.S. Pat. No. 5,436,705 at column 6, lines 65–69 and column 7, lines 1–11) is imaged in the interdocument area of the photoconductive surface. One skilled in the art will appreciate that the developed test patch is not transferred to a copy sheet. At step 77, TAC sensor readings are taken for the toned areas of the patch. The relative reflectance values obtained, at step 77, for each patch segment are compared to Tonal Reproduction Curve targets. Error terms are then generated, at step 77, to signify an error value for solid area density, halftone density, and highlight density. At step 148, steps 150, 152, 154, and 77 are repeatedly executed for a time period of 20 seconds or while the value of the error terms is less than 4 units, whichever occurs first.

Figure 10:
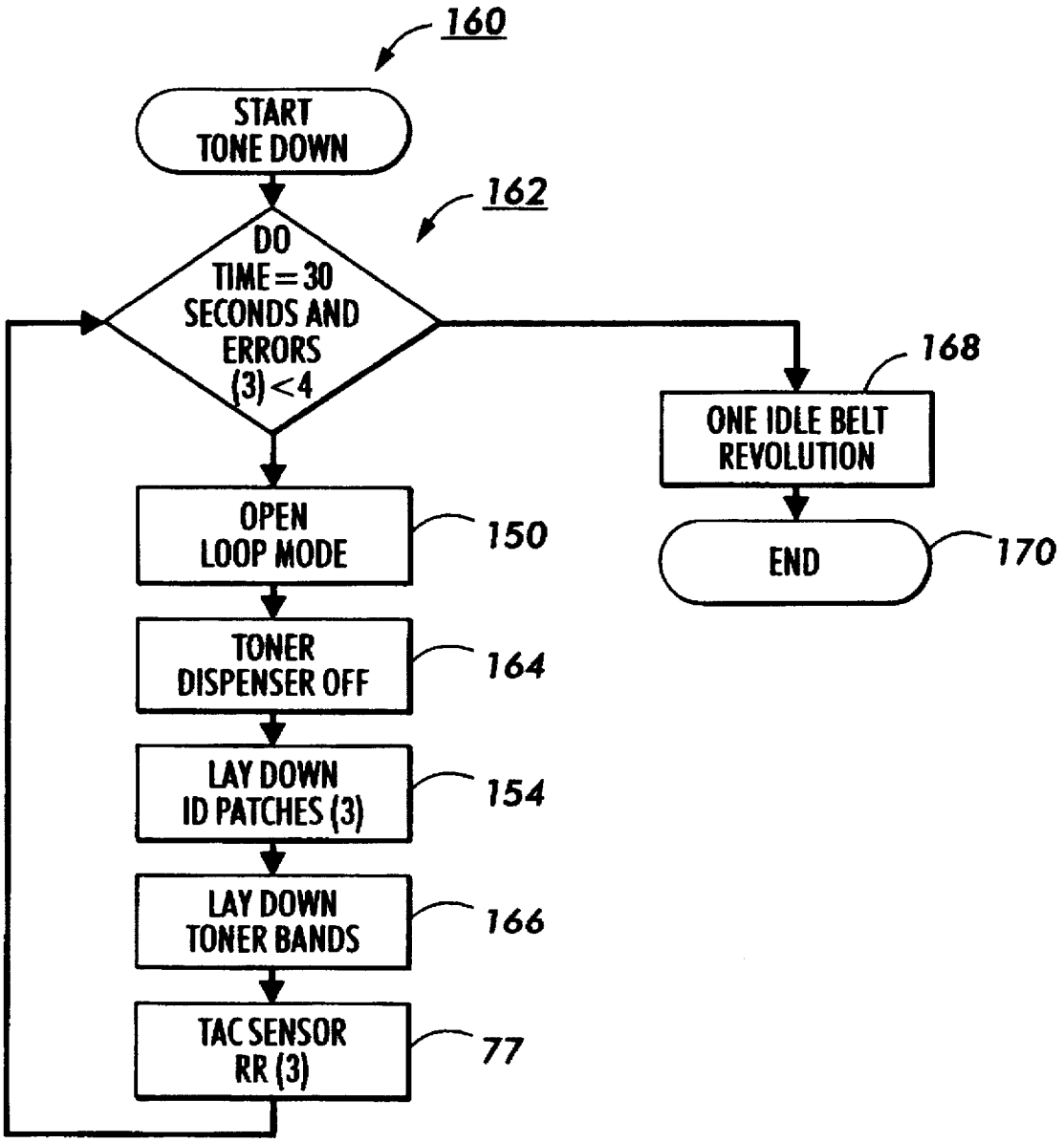
FIG. 10 is a diagrammatic representation of the operations involved in decreasing toner concentration in a tone down routine in the toner concentration/tribo set up loop.

FIG. 10 illustrates a diagrammatic representation of the Tone Down routine that starts at step 160. The Tone Down routine is a set of steps enclosed between a DO block 162 and an END 170 to decrease toner concentration. Step 150 places the printing machine in the open loop mode so that paper does not pass through the machine. The toner dispenser is turned off, at step 164, preventing the transport of toner particles to the developer unit. At step 154, the composite toner test patch (described in U.S. Pat. No. 5,436,705 at column 6, lines 65–69 and column 7, lines 1–11) is imaged in the interdocument area of the photoconductive surface. Along with the composite toner patch, a plurality of 15 millimeter wide toner bands (87.5%) are placed across the entire width of the image zones (from inboard to outboard edge), at step 166. These toner bands take toner material out of the developer unit so as to reduce toner concentration in the developer sump. The composite toner patch and the image zone toner bands are produced simultaneously for calibration purposes. Since PIDC changes occur along the entire length of the photoconductive belt surface, it is necessary to calibrate PIDC changes in the image zone to PIDC changes in the interdocument zone and take the difference therebetween as the new discharge characteristic. At step 77, TAC sensor readings are taken for the toned areas of the test patch and the image zone bands. The relative reflectance values for both, at step 77, are compared to Tonal Reproduction Curve targets and error terms are generated thereafter. Steps 150, 164, 154, 166, and 77 are repeatedly executed, at step 162, for a time period of 30 seconds or while the value of the error terms is less than 4 units, whichever occurs first. Control then passes to step 168, wherein a single belt revolution occurs to assure effective cleaning of the photoconductive surface. After cleaning, the Tone Down routines ends at step 170.

In recapitulation, it is clear that the set up procedure of the present invention is accomplished by using feedback from a single TAC sensor. The process is accomplished in three layers. A first layer consists of utilizing the real-time estimation routines in the adaptive controller to estimate image quality sensitivity coefficients required therein. If convergence with the Tonal Reproduction Curve is not reached at the first layer, the setup proceeds to a second layer. The second layer adjusts developer bias voltages based on corresponding actuator movements. If convergence with the Tonal Reproduction Curve is not reached at the second layer, the set up proceeds to a third layer. The third layer changes toner concentration based on actual relative reflectance levels and actuator levels. If convergence with the Tonal Reproduction Curve is not reached at the third layer, the set-up procedure issues an image quality fault. Correspondingly, if convergence is reached at any layer, the set up procedure exits to real-time machine operation.

It is, therefore, evident that there has been provided, in accordance with the present invention, a procedure for setting up an electrophotographic printing machine using a Toner Area Coverage sensor that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall within the spirit and broad scope of the appended claims.

I claim:

1. A method of adjusting image quality in a printing machine having a variable density image developed on a photoconductive surface in accordance with an initial set of starting values, including:

detecting a plurality of densities of the variable density image and transmitting a plurality of signals with each signal being indicative of a density;

generating new starting values, responsive to the plurality of signals, using a linearized perturbation model;

calculating error values, responsive to the plurality of signals, minimizing a sum of squares of the error values;

testing the error values for convergence to a set of reference values with each reference value indicative of an acceptable density;

repeating said detecting, transmitting, generating, calculating, and testing, steps for a plurality of iterations;

branching to a component responsive to the error values exceeding the reference values and the plurality of iterations exceeding a first prescribed value; and adjusting the component, said adjusting comprises adjusting a voltage for a developer unit having a mixture of toner particles and carrier granules therein, and adjusting a toner dispenser for discharging toner particles into the developer unit, including:

comparing a developer state variable to a first development parameter;

generating a toner concentration value, responsive to the developer state variable exceeding the first development parameter;

comparing the developer state variable to a second development parameter;

generating a second toner concentration value, responsive to the developer exceeding the second development parameter;

adjusting the voltage for the developer unit;

detecting a plurality of densities of the variable density image and transmitting a plurality of signals with each signal being indicative of a density;

generating new starting values, responsive to the plurality of signals, using a linearized perturbation model;

calculating error values, responsive to the plurality of signals, minimizing the sum of squares of the error values;

testing the error values for convergence to a set of reference values with each reference value indicative of an acceptable density;

repeating said adjusting, detecting, transmitting, generating, calculating, and testing steps for the first mentioned plurality of iterations and a second plurality of iterations; and branching to a second component, responsive to the error signals exceeding the reference signals, and the first mentioned plurality of iterations exceeding the first mentioned prescribed value and the second plurality of iterations exceeding a second prescribed value.

2. A method according to claim 1, further including forming on the photoconductive surface the variable density image with a solid area density region, a halftone density region and a highlight density region.

3. A method according to claim 1, further includes:

decreasing toner particle concentration in the developer unit, responsive to the first mentioned toner concentration value;

increasing toner particle concentration in the developer unit, responsive to a second toner concentration value.

detecting a plurality of densities of the variable density image and transmitting a plurality of signals with each signal being indicative of a density;

generating new starting values, responsive to the plurality of signals, using a linearized perturbation model;

calculating error values, responsive to the plurality of signals, minimizing a sum of the squares of the error values;

testing the error values for convergence to a set of reference values with each reference value indicative of an acceptable density;

repeating said adjusting, detecting, transmitting, generating, calculating, and testing steps for the first mentioned plurality of iterations and the second plurality of iterations; and branching to an image quality fault when the first mentioned plurality of iterations is greater than the first mentioned prescribed value.

4. A method according to claim 3, wherein decreasing toner concentration comprises a toning down cycle, including:

disengaging the toner dispenser;

developing the variable density image in an interdocument area on the photoconductive surface;

developing a single density solid area images in an image area on the photoconductive surface;

detecting the variable density image and the solid area density image and generating a first set of density signals and a second set of density signals indicative thereof;

comparing the first set of density signals and the second set of density signals to reference values and calculating error values responsive thereto;

repeating the disengaging, developing, detecting, and comparing steps for a time period less than a prescribed time period or for error values less than prescribed error values, whichever occurs first; and cleaning the photoconductive surface.

5. A method according to claim 3 wherein increasing toner concentration comprises a toning up cycle, including:

engaging the toner dispenser;

developing the variable density image in an interdocument area on the photoconductive surface;

detecting the variable density image developed and generating a density signal indicative thereof;

comparing the density signal to a reference value and calculating an error signal, responsive thereto; and repeating the engaging, developing, detecting, and comparing steps for a time period less than a prescribed time period or for an error value less than a prescribed error value, whichever occurs first.

* * * * *